US010450126B2

(12) United States Patent
Branyon et al.

(10) Patent No.: US 10,450,126 B2
(45) Date of Patent: Oct. 22, 2019

(54) DIE-CUT PATTERNS FOR BLISTER PACKAGE

(71) Applicant: Sonoco Development, Inc., Hartsville, SC (US)

(72) Inventors: Jacob D. Branyon, Hartsville, SC (US); Donald McArthur, Oswego, NY (US); Benjamin Davis, West Chester, OH (US)

(73) Assignee: Sonoco Development, Inc., Hartsville, SC (US)

( * ) Notice: Subject to any disclaimer, the term of this patent is extended or adjusted under 35 U.S.C. 154(b) by 38 days.

(21) Appl. No.: 13/950,596

(22) Filed: Jul. 25, 2013

(65) Prior Publication Data

US 2013/0306511 A1 Nov. 21, 2013

Related U.S. Application Data

(63) Continuation-in-part of application No. 13/176,933, filed on Jul. 6, 2011, now Pat. No. 9,138,378.
(Continued)

(51) Int. Cl.
*B65D 83/04* (2006.01)
*B65B 61/02* (2006.01)
(Continued)

(52) U.S. Cl.
CPC ..... *B65D 83/0445* (2013.01); *B65B 9/045* (2013.01); *B65B 61/02* (2013.01);
(Continued)

(58) Field of Classification Search
USPC ..... 206/528, 531, 532, 538–539, 461
See application file for complete search history.

(56) References Cited

U.S. PATENT DOCUMENTS 2,680,558 A 6/1954 Mai
2,967,010 A 1/1961 Cuffey, Jr. et al.
(Continued)

FOREIGN PATENT DOCUMENTS

DE 4402038 A1 7/1995
EP 1828009 B1 2/2011
(Continued)

OTHER PUBLICATIONS

Declaration of Benjamin Davis, submitted in U.S. Appl. No. 12/011,116 (signed Jul. 20, 2011).
(Continued)

*Primary Examiner* — Robert Poon
(74) *Attorney, Agent, or Firm* — Flaster/Greenberg P.C.

(57) ABSTRACT

A blister package is formed for retaining individual products. The package includes a receptacle substrate having a sealing flange and at least one receiving cell formed to retain product therein. A polymer top layer covers the cell and a portion thereof is sealed to the sealing flange. A score pattern is formed in at least one surface of the top layer and overlapping the cell. The score pattern is defined by a first plurality of score lines formed in a repeating pattern and a second plurality of score lines formed in a repeating pattern. The first and second plurality of rows overlap one another to define a plurality of intersections, with the overall score line pattern having a total linear length of the score lines per cell of at least 5 inches and a total number of score line intersections per cell of at least 10.

22 Claims, 5 Drawing Sheets

Related U.S. Application Data

(60) Provisional application No. 61/675,588, filed on Jul. 25, 2012.

(51) Int. Cl.
*B65D 75/32* (2006.01)
*B65B 9/04* (2006.01)
*A61J 1/03* (2006.01)

(52) U.S. Cl.
CPC ..... *B65B 61/025* (2013.01); *B65D 75/327* (2013.01); *A61J 1/035* (2013.01); *B65D 2575/3227* (2013.01)

(56) References Cited

U.S. PATENT DOCUMENTS

| | | | | |
|---|---|---|---|---|
| 3,004,697 | A | 10/1961 | Stone | |
| 3,421,615 | A | 1/1969 | Salzer et al. | |
| 3,759,371 | A | 9/1973 | Marks | |
| 3,863,834 | A | 2/1975 | Sandford | |
| 3,872,970 | A | 3/1975 | Edison | |
| 3,942,640 | A | 3/1976 | Hellstrom | |
| 3,948,394 | A | 4/1976 | Hellstrom | |
| 3,986,640 | A | 10/1976 | Redmond | |
| 4,243,144 | A | 1/1981 | Margulies | |
| 4,317,399 | A | 3/1982 | Romagnoli | |
| 4,342,395 | A | 8/1982 | Brown | |
| 4,537,312 | A | 8/1985 | Intini | |
| 4,911,304 | A | 3/1990 | Bunin | |
| 5,014,851 | A | 5/1991 | Wick | |
| 5,150,793 | A | 9/1992 | Tannenbaum | |
| 5,172,812 | A | 12/1992 | Wharton et al. | |
| 5,310,060 | A | 5/1994 | Bitner et al. | |
| 5,339,960 | A | 8/1994 | Price | |
| 5,360,116 | A | 11/1994 | Schmiletzky | |
| 5,469,968 | A | 11/1995 | Matthews et al. | |
| 5,529,188 | A | 6/1996 | Coggswell | |
| 5,685,431 | A * | 11/1997 | Chambers et al. | 206/521 |
| 5,791,478 | A | 8/1998 | Kalvelage et al. | |
| 5,944,191 | A | 8/1999 | Ray et al. | |
| 6,006,913 | A | 12/1999 | Ludemann et al. | |
| 6,212,858 | B1 | 4/2001 | Breitler | |
| 6,422,391 | B1 | 7/2002 | Swartz | |
| 6,516,949 | B2 | 2/2003 | Fuller et al. | |
| 6,637,431 | B2 | 10/2003 | Ekelius et al. | |
| 6,659,280 | B2 | 12/2003 | Paliotta et al. | |
| 7,093,716 | B2 | 8/2006 | Intini | |
| 7,188,728 | B2 | 3/2007 | Williams-Hartman | |
| 8,079,475 | B2 | 12/2011 | McArthur et al. | |
| 2002/0162768 | A1 | 11/2002 | Bolnick et al. | |
| 2003/0102247 | A1 | 6/2003 | Inoue et al. | |
| 2004/0175527 | A1 | 9/2004 | Shiota et al. | |
| 2005/0016134 | A1 | 1/2005 | Prebelli et al. | |
| 2005/0284789 | A1 | 12/2005 | Carespodi | |
| 2007/0227932 | A1 | 10/2007 | Bobbett et al. | |
| 2008/0073240 | A1 | 3/2008 | Bowers et al. | |
| 2008/0230432 | A1 * | 9/2008 | Bobbett et al. | 206/531 |
| 2009/0145800 | A1 * | 6/2009 | Bowers et al. | 206/532 |
| 2010/0072104 | A1 | 3/2010 | Kohl | |
| 2010/0243508 | A1 * | 9/2010 | Sekiguchi et al. | 206/531 |
| 2012/0061282 | A1 | 3/2012 | McArthur et al. | |
| 2013/0008825 | A1 | 1/2013 | McArthur et al. | |

FOREIGN PATENT DOCUMENTS

| | | | |
|---|---|---|---|
| FR | 2757835 | A1 | 7/1998 |
| GB | 2343440 | A | 5/2000 |
| GB | 2414982 | B | 8/2007 |
| JP | 05161692 | A | 6/1993 |
| JP | 07149367 | A | 6/1995 |
| JP | 10323955 | A | 12/1998 |
| WO | 2005056419 | A1 | 6/2005 |
| WO | 2006012314 | A1 | 2/2006 |
| WO | 2007113850 | A1 | 10/2007 |
| WO | 2009143234 | A1 | 11/2009 |
| WO | 2010077797 | A1 | 7/2010 |

OTHER PUBLICATIONS

Declaration of Jacobs Branyon, submitted in U.S. Appl. No. 13/176,933 (signed Jun. 20, 2013).

* cited by examiner

DIE-CUT PATTERNS FOR BLISTER PACKAGE

CROSS-REFERENCE TO RELATED APPLICATION

This application is a continuation-in-part of pending application Ser. No. 13/176,933, filed Jul. 6, 2011, and published as US 2013/0008825 on Jan. 10, 2013, and claims the benefit of U.S. Provisional Application No. 61/675,588, filed Jul. 25, 2012.

FIELD OF THE INVENTION

The present invention relates to packaging and in particular blister packaging of the type used to retain product in a receptacle hollow. The present invention further relates to the formation of a blister package.

BACKGROUND OF THE INVENTION

Blister packages are commonly used to retain consumable products, such as candy, gum, powders, tablets and the like. This type of packaging is convenient for separately securing individual product portions or doses. Each individual portion may be dispensed from the package while leaving additional portions sealed within the package. Such blister packages may also be used for non-consumable products, such as toys, hardware, etc.

U.S. Pat. No. 8,079,475 to McArthur et al. shows a blister package wherein the covering layer is formed of a polymer material and is provided with a plurality of score lines formed within the covering layer. The lines form a repeating pattern substantially across the area of the blister package. This patent is herein incorporated by reference.

US 2005/0284789 to Carespodi shows a blister package including a backing laminate having a polymer layer, a foil layer and adhesive layers. The laminate is laser scored to assist in the push through dispensing of product from the blister receptacle.

WO 2005-056419 to Bobbett discusses release zones, which form an outline of the product, and patterns having rows of straight dashed lines extending across the surface of the blister package. In one embodiment the dashed lines intersect, creating a "+" shaped formation.

Japanese patent publications JP 05161692 and JP 07149367 appear to describe blister packages with laser slits on a sealing layer made from a plastic film. The covering film of the sealing layer includes multiple slits, centrally positioned over a receptacle hollow.

SUMMARY OF THE INVENTION

A blister package is formed for retaining individual products. The package includes a receptacle substrate having a sealing flange and at least one receiving cell or receptacle hollow formed to retain product therein. A polymer top layer covers the cell and a portion thereof is sealed to the sealing flange. A score pattern is formed in at least one surface of the top layer and overlaps the cell. The score pattern is formed for promoting propagation of a tear in the top layer upon application of a transverse force of the product within the cell against the portion of the top layer overlapping the cell. The score pattern is defined by a first plurality of score lines formed in a repeating pattern and a second plurality of spaced score lines formed in a repeating pattern. The first and second pluralities of score lines intersect one another.

In a further aspect of the disclosure, the total linear length of the score lines per cell is at least 5 inches, with a preferred length exceeding 6 inches.

In a still further aspect of the disclosure, the ratio of the linear length of score lines to the cell area is at least 10.6, with a preferred ratio exceeding 12.8.

A further aspect of the disclosure defines a total number of score line intersections per cell of at least 10, with a preferred number being at least 12 intersections.

Variations in the form of the score line patterns are contemplated within these defined parameters.

BRIEF DESCRIPTION OF THE DRAWINGS

For the purpose of illustrating the invention, there is shown in the drawings a number of forms which are presently preferred; it being understood that the invention is not limited to the precise arrangements and instrumentalities shown.

FIG. 5 also includes a graph showing the linear inches per cell for the various score line patterns shown.

FIG. 6 includes a graph showing the number of intersections per cell for the various score line patterns shown.

DETAILED DESCRIPTION

Figure 1:
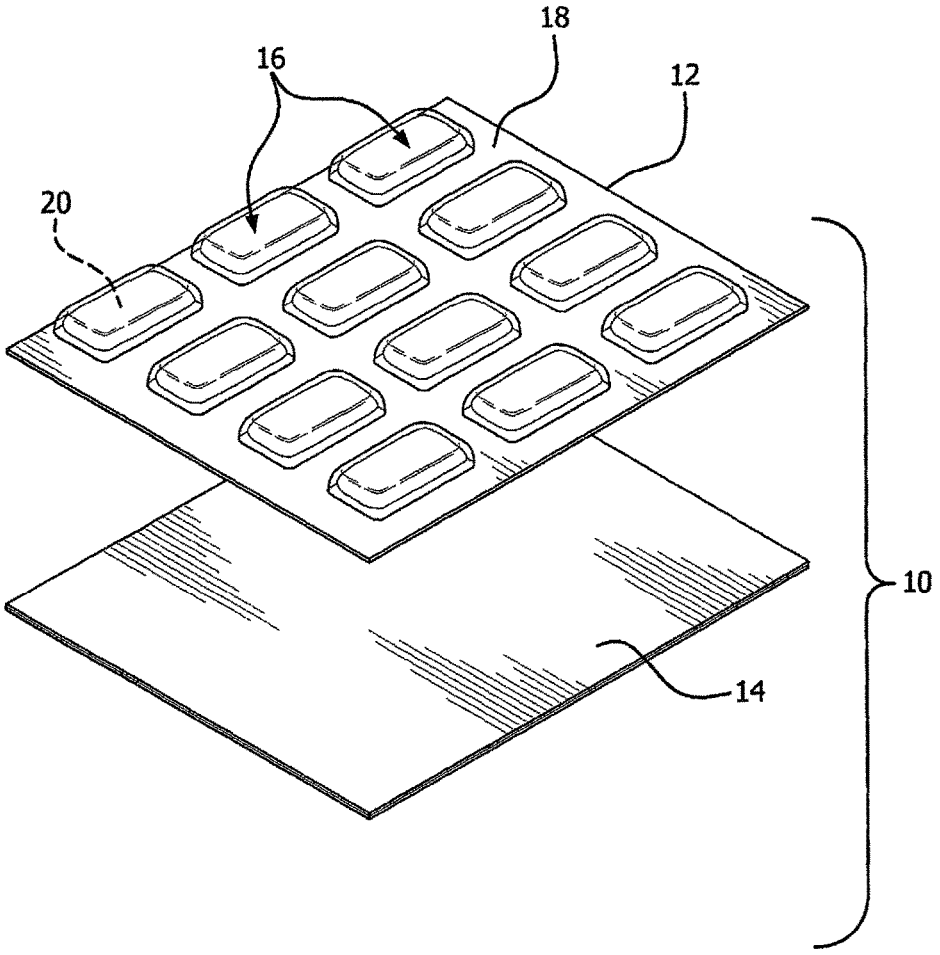
FIG. 1 is an exploded perspective view of the constituent parts of a blister package of a form presently contemplated.

Referring now to the drawings, where like numerals identify like elements, there is shown in FIG. 1 a blister package which is generally referred to by the numeral 10. In FIG. 1, the constituent parts of the blister package 10 are shown as including a receptacle substrate 12 and a top or cover layer 14. The receptacle substrate 12 includes a plurality of receptacle hollows or cells 16 arranged in an aligned pattern or array, with each cell 16 surrounded by a planar sealing flange 18. As shown, the cells 16 are separated by a portion of the sealing flange 18, with each cell 16 retaining a single product 20. The blister package may be formed with any number of cells, including a single cell, and may be arranged in any desired pattern. Each cell may retain an individual product, such as the gum tablet illustrated, multiple products or a quantity of loose product, such as a powder or granular material. A series of separation lines (not shown) may be provided within the sealing flange, between adjacent cells, or multiple cells, so as to permit separation of a portion of the substrate from the remainder, as desired.

Figure 2:
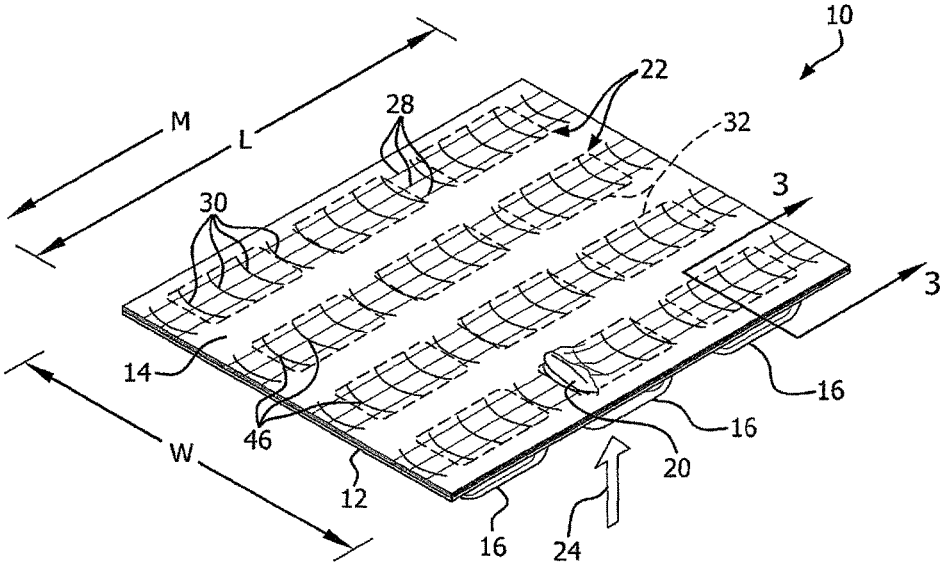
FIG. 2 is a perspective view of an assembled blister package of the type shown in FIG. 1, showing the top or cover portion of the package.

In FIG. 1, the top layer 14 is shown as separated from the receptacle substrate 12 for illustration purposes. As shown in FIG. 2, the top layer 14 is joined to the sealing flange 18 such that each individual cell 16 is covered and closed. A score pattern 22 is formed within the top layer 14. The score pattern 22 is provided for the propagation of a tear (or multiple tears) within the top layer upon the application of a transverse force against the cell 16 and the product 20 retained within the hollow of the cell 16. In FIG. 2, the transverse push-through or break-through force is represented by the arrow 24, with the resulting tear in the top layer 14 adjacent the hollow 18 releasing a previously sealed product 20.

The score pattern 22 in FIG. 2 is essentially that shown and described in commonly assigned, copending U.S. application Ser. No. 13/176,933, filed Jul. 6, 2011. This copending application is herein incorporated by reference. The score pattern 22 includes a plurality of rows of straight lines 28 and a further plurality of bowed lines 30, which are positioned transverse to the straight line rows. The bowed lines 30 are also aligned with one another and intersect the straight lines 28 in multiple places within the area of the top layer covering the cell or receptacle hollow (shown by dotted lines 32). The score pattern 22 is aligned over each cell (32) and includes three parallel straight lines 28 that are equidistantly spaced from one another and at least three parallel bowed lines 30. The pattern of straight lines 28 extends across the length L of the package 10 and, as shown, is continuous along the length of each line. The pattern of bowed lines 30 is aligned and repeats across the longitudinal length L of the package 10. As shown, the bowed lines 30 are discontinuous in the width W direction of the package 10.

Figure 3:
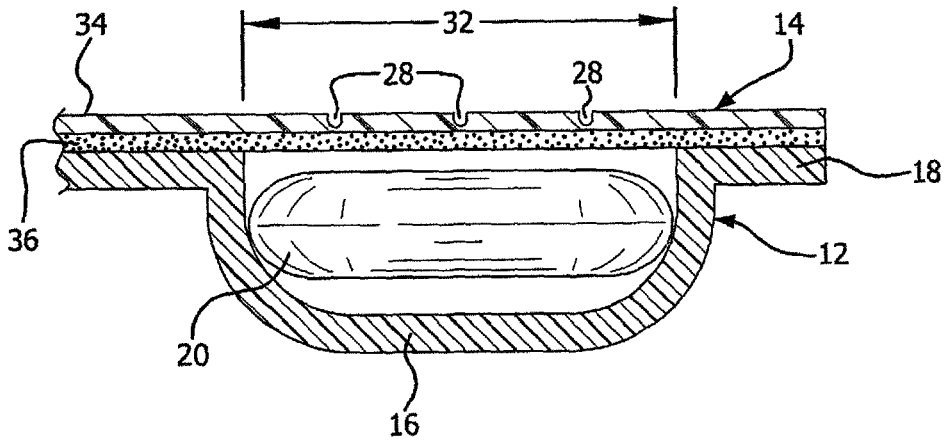
FIG. 3 is a cross section view of the blister package assembly of FIG. 2 as taken along lines 3-3.

In FIG. 3, the elements of a sealed package 10 are shown. The product 20 is positioned within a cell 16 formed in the substrate 12. The open end 32 of the cell 16 is covered by the top layer 14. The sealing flange 18 surrounds the cell opening 32 and the top layer 14 is sealed to the flange 18. In the cross section taken, the straight lines 28 are score lines that penetrate into the thickness of the top layer 14 without going all the way through. The bowed lines 30 are contemplated to be similarly formed in the top layer 14. The depth of the score lines into the top layer 14 may vary, as may the thickness of the scoring.

As shown, the relatively outer part 34 of the top layer 14 is the structural portion of the layer and is formed of a polymer material. The second or inner part 36 of the top layer 14 forms the sealing surface for attachment of the top layer 14 to the sealing flange 18. Preferably, a seal coating 36 is applied to the inside surface of the outer part 34. The seal coating 36 is provided to facilitate heat sealing of the top layer 14 to the flange 18. Alternatively, the inner part 36 of the top layer may be a separate polymer layer and may be formed as part of a laminate structure, with the inner part being compatible with the material of the sealing flange. A laminate structure may also be provided as the structural part of the top layer and a separate heat seal coating may be applied on the inner surface of the laminate. As a further alternative, the top layer may be secured to the flange by a patterned adhesive or similar attachment mechanism. A print layer (not shown) may be provided within the structure and other layers may be included or added. It is preferred that the top layer not include a paper, foil or metal layer.

Figure 4:
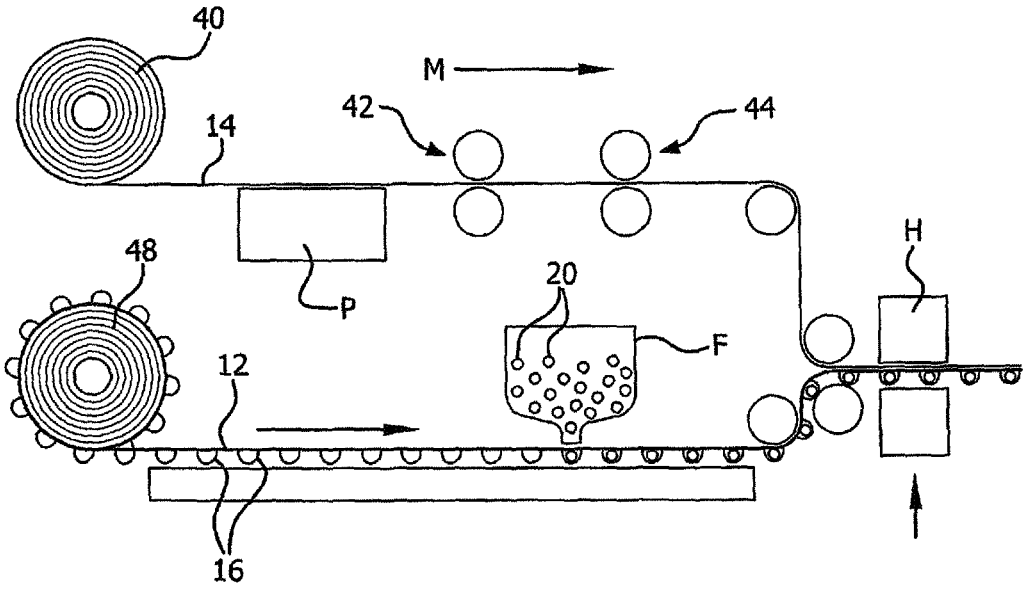
FIG. 4 is a schematic view of a blister package assembly process.

Schematically shown in FIG. 4 is a forming and assembly process for the blister package 10. The polymer material used to form the top layer 14 is shown in web form and is provided in a roll 40. The web is wound off of the roll 40 and is fed to a printing station P. The web may be printed on either or both surfaces. Various portions of the overall score line pattern are preferably applied in separate operations. These various portions of the overall score line pattern may be applied to one surface of the top layer or on both surfaces. As shown, in a first station 42, a first repeating score line pattern (such as the straight lines 28) is formed in the web surface. The score lines are preferably formed on a continuous basis by a rotary die-cutting roller as the web moves in the machine direction M of the processing machinery. A second station 44 is provided to form a second set or plurality of score lines in the surface of the polymer film (such as the bowed lines 30). The form and position of the two score line patterns may vary. In addition, the number and angle of the intersections may vary as a result of the two patterns.

Separation of the cuts for the various score line patterns within the overall pattern is contemplated to simplify the manufacturing process and the formation of the die-cutting rollers. Although two separate patterns are shown in the schematic process of FIG. 4, additional cutting stations may be included to complete the completed score line pattern. Separation of the cutting operations has a positive effect of reducing the heat during the die-cutting process. The separation of the two cuts may also assist in controlling the depth and accuracy of the cuts. A uniform depth of cut is one factor in reducing unintended break through and in setting a consistent force required to expel product.

Once the score pattern is completed within the surface of the film, the web is moved to be joined with the sealing flange. The receptacle substrate 12 is shown in rolled from 48. The cells 16 may be formed as part of the overall process or prior to the formation of the roll 48. The cells 16 in the substrate 12 are filled with product 20 at a filling station F and the open end of each hollow is brought into alignment with the top layer 14 at the heating station H (or similar station for securing the top layer to the substrate). The top layer 14 is sealed to the sealing flange (18) to close each cell 16 (and seal the product 20 therein). The combined web and substrate is cut and separated to define a package having the desired size and number of product filled cells.

The schematic of FIG. 4 is provided to show the steps of the assembly process for a finished package. These steps may be performed together or as part of separate operations. For example, the web material forming the top layer 14 may be printed, coated and die-cut as part of one operation or separate processing operations. The printed, coated and cut web, which is stored in a roll, may be slit to form narrow rolls, having a width comparable to one package. The slit rolls may then be separately sealed to the receptacle substrate, with the individual packages cut from the elongated combination. Alternatively, the slitting of the top layer may be performed at a separate time from the printing and coating operation. Other operations may be performed within this general process outline.

It has been found that one desired quality of a blister package of the type shown (with a polymer top layer and a defined score pattern therein) relates to the force required for discharging product from a cell. A consistent push-through force is preferable within each blister package and similarly within a plurality of similarly formed blister packages. Hence, it is preferable that there be a minimum of deviation in discharging product from each cell.

In one example, the blister package may be utilized for gum or other confection products. One desirable feature within this type blister package is a relatively low push-through force. It should be relatively easy to discharge the product from the cell. However, the required push-through force should be sufficient for the package to maintain its integrity during assembly, shipping and handling. Hence, the occurrence of accidental tearing of the top layer is preferably minimized.

It is preferred that the score line pattern form in the top layer of the blister package have a consistent depth of cut across the cell and across multiple cells. In addition, in the assembly of the package, the position of the score pattern is preferably formed in registration with the cell opening for consistency of the linear length of the score lines and the number and position of the score line intersections. Additional factors that may affect the consistency of the required push-through force may include—but not be limited to—the strength of the polymer top layer, the thickness of the layer, the tension in the web during the scoring operation or sealing operation, and the heat generated during scoring and sealing.

The parameters of a consistent push-through force are defined by empirical testing of various score line patterns. Generally, it is desirable to have a relatively large number of linear inches of score lines in the overall pattern covering the open portion of the cell. In addition, a relatively large number of intersections within the score line formation generally provides consistent push-through results.

In evaluating various score patterns for a blister package covering layer, a testing device may be utilized having a probe that moves against a secured film or web to simulate the push-through force for discharging a product from a blister receptacle. The test film/web is retained by a fixture that simulates a grid of receptacles within a blister package. The fixture secures the film/web in a manner similar to the securing of the film/web to a sealing flange of the blister package. The fixture divides the film/web into separate cells having dimensions corresponding to the cell of a blister receptacle. The probe is connected to equipment that measures the force applied by the probe when placed in contact with the film/web portion. The probe moves at a constant rate in a single transverse direction, applying a force to the web/film, until the film/web material within the test cell "fails". Failure of the film/web results when the probe punctures or breaks through the material, simulating the push-through discharge of the product (such as a gum pellet or similar object). The probe is moved in a pattern across the grid of simulated cell cover portions, measuring the push-through force at a plurality of cells. The data from the plurality of cells is then analyzed for average push-through force and for consistency of the results.

The push-through test results for various score patterns within a polymer film material may be compared to a standard or "control" force. For example, the results obtained from a testing device for a scored polymer film may be compared to the test results for a typical aluminum foil material, such as a foil for covering a gum package. This material is normally 0.0011 inches thick. It has been found that such a typical foil web requires a range of 4 to 8 lbs for push-through of the product from with the receptacle hollow.

Figure 5:
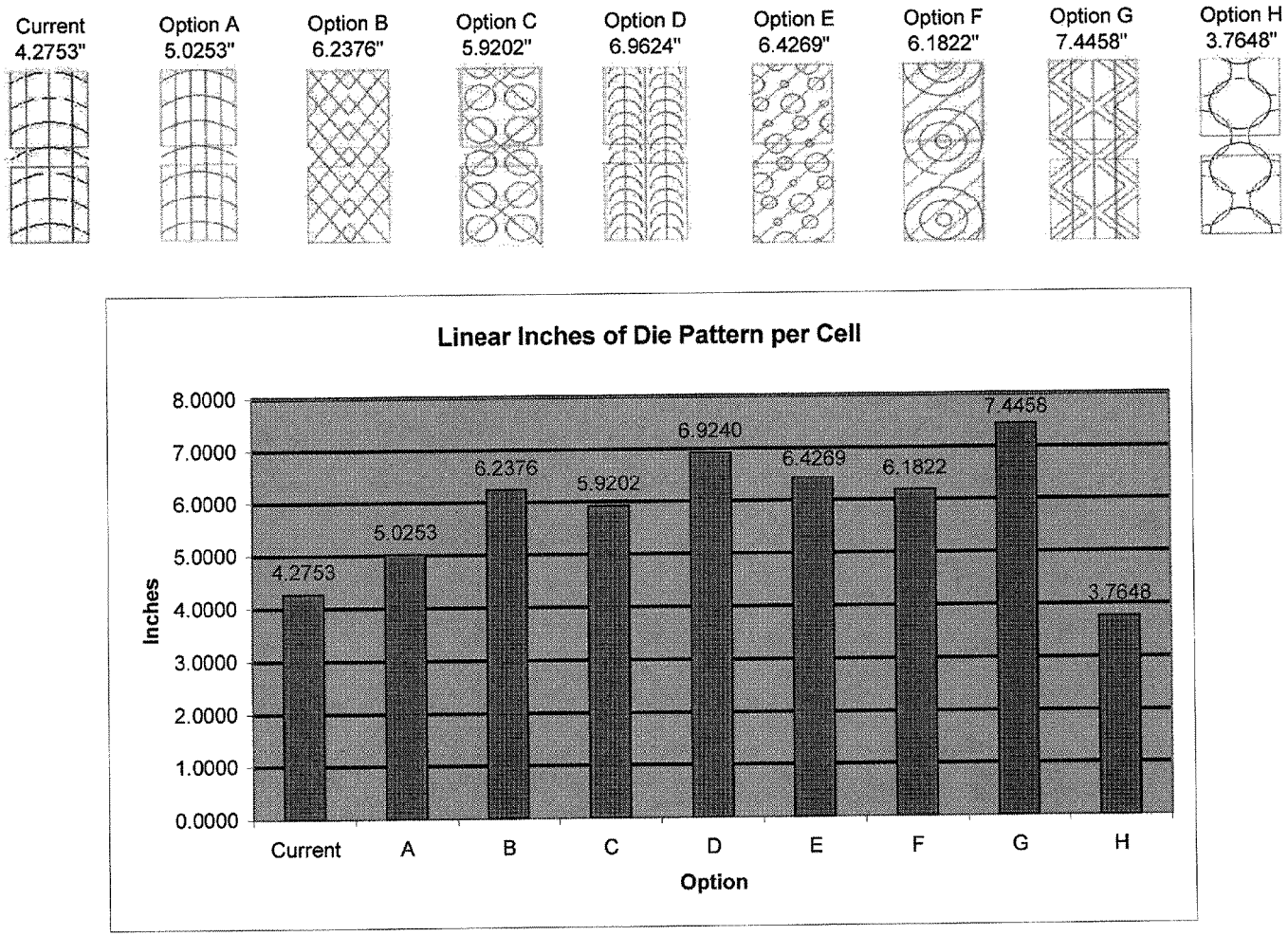
FIG. 5 shows various embodiments of a score line pattern for application to a top layer of a blister package of the type shown in FIGS. 1-3 and formed by a process similar to that shown in FIG. 4.

In FIG. 5, there is shown a plurality of embodiments of die-cut score line patterns. In each of the examples shown in FIG. 5, the outlines of two cells are provided. The cell outlines surround a portion of the score line pattern that repeats across the surface of the material forming the top layer. A separation of the outlined cells represents a portion of the sealing flange of the blister package. The embodiment labeled "Current" is that shown in FIG. 2 and is discussed in co-pending application Ser. No. 13/176,933, as herein incorporated by reference. A similarly formed pattern is labeled Option A in FIG. 5 and includes an additional straight line within the pattern. (This Option A pattern is similar to that shown in FIG. 5 of the above identified application.) These two die-cut patterns each include bowed lines formed with a rounded apex and trailing wings. In the continuous formation of the score line pattern by a die-cutting roller, the apex and the wings are progressively formed during the movement of the web through the rotary cutting station (44). The apex may lead the scoring (die-cutting) operation in the machine direction M. Alternatively, the apex may be formed at the end of the progression of the scoring operation in the machine direction M.

Figure 6:
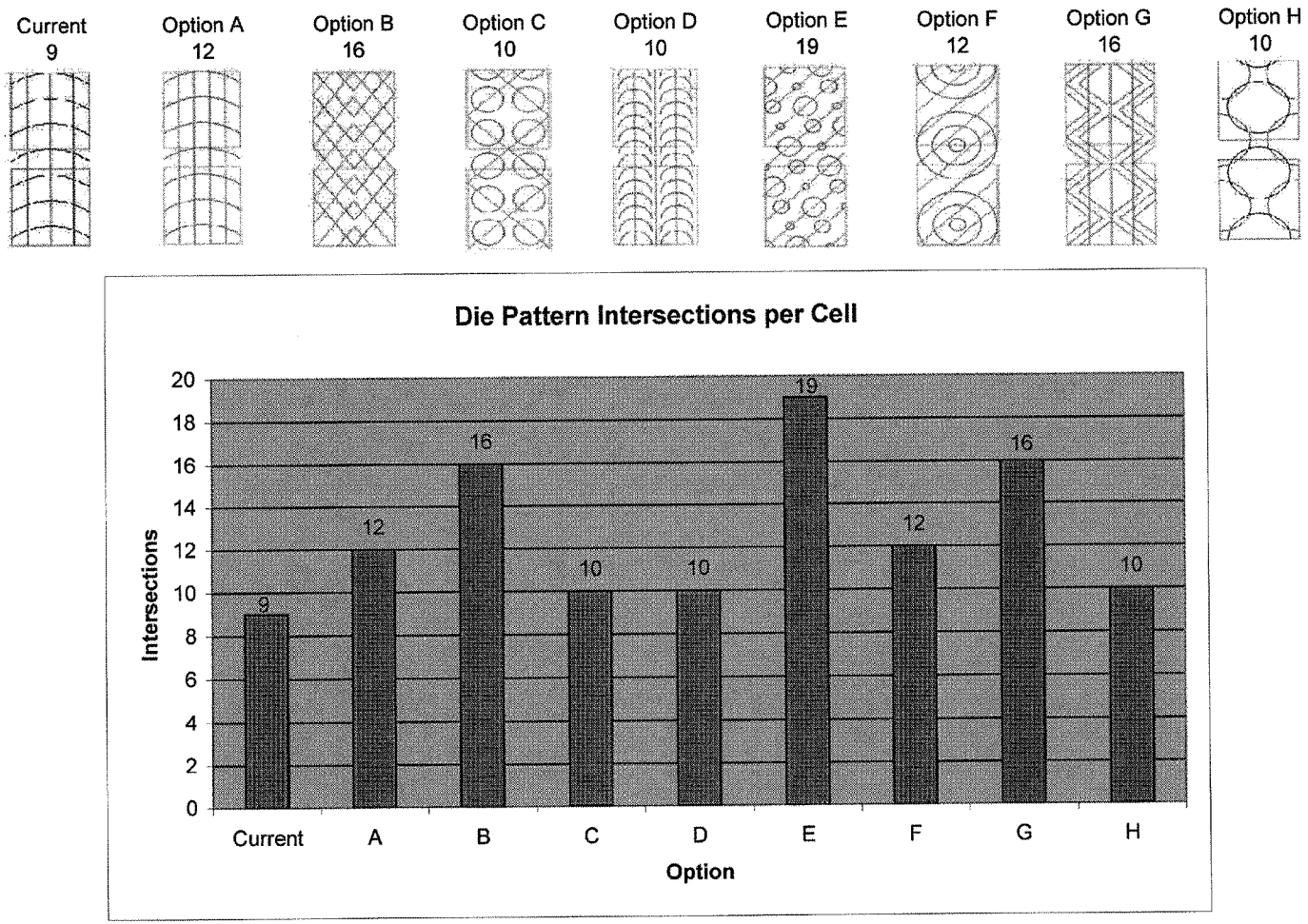
FIG. 6 also shows the various embodiments of a score line patterns as set forth in FIG. 5.

In the graph of FIG. 5, it is shown that in the Current pattern there is a total of 4.28 linear inches of score lines within the area of the top layer covering a cell opening. This measurement was made upon application of the score line pattern to a typical cell size of 0.625 inches by 0.750 inches, or a total cell opening area of about 0.47 square inches (less than 0.5 square inches). By comparison to the Current pattern, the pattern labeled Option A, with the additional straight line provides about 5.03 linear inches of score lines within the defined cell opening area. As shown in the graph of FIG. 6, the number of intersections per cell for the Current pattern is 9, with the number of intersections for Option A pattern being 12. For purposes of the present disclosure, it is contemplated that an increase in cell area will result in proportional increase in a total linear length of score lines and potentially an increase in the number of intersections. Hence, the ratio for the Current pattern is approximately 9.1 linear score lines per cell area. The score lines to cell area ratio for the Option A pattern is approximately 10.7.

The Current pattern and Option A both result in an average push-through force in the range of the foil control or target range of 4-8 lbs. However, the deviation in the push-through force is recognizably higher in considering the test data in the Current pattern verses the Option A pattern. This higher deviation in the current pattern typically means that the force required in any given cell opening may exceed the target range. It is concluded from the data that an increase in the linear inches of the score pattern, in addition to an increase in the number of line intersections, provides advantageous, more consistent results.

The Option B pattern includes a two-opposing pattern of chevron shaped lines. The chevrons appear to form apex points. Each chevron is relatively closely spaced with adjacent chevron lines. The total linear length of score lines is increased to 6.24 inches, corresponding to a score line to cell area ratio of about 13.3. In addition, as represented by the graph in FIG. 6, the number of intersections per cell in this Option B pattern is 16.

The pattern labeled Option C shows a series of crossed straight lines combined with a pattern having rows of circles. As shown, the straight line pattern creates a crossed "X" with intersections within the straight line patterns. The X formation intersects with four circles formed in two rows over the cell openings. The X lines may be formed by a single die-cutting roller or the portions of the X may be separated on two rollers, with a third roller providing the circle pattern. Another method of formation may include one die-cutting roller having a first pattern with one half of the X pattern and a set of two circles adjacent thereto. The second roller would create the same pattern in mirror image, with the two rollers combining to create the total pattern illustrated. In the graph in FIG. 5, this Option C pattern includes a total of 5.92 linear inches of score lines, or a score line length to cell area ratio of about 12.6. In the graph in FIG. 6, the number of intersections created is identified as 10.

The pattern example labeled Option D includes a straight line pattern overlapping rows of aligned curves. The curves are spaced relatively closer than those shown in the Current example and the Option A example. Three straight or lineal lines are included in the pattern, two intersecting the curves and one straight line formed between the curves. In FIG. 5, the graph shows that the total length of score lines per cell is relatively greater that the prior examples, due to the density of the lines. A length of score lines is 6.92 inches, with a score line to cell area ratio of about 14.7. In FIG. 6, the graph shows that the number of intersections is a relatively low value of 10. It is noted that an increase in the number of intersections, with a small increase in the total linear line length, would result from a connection between the curved lines.

The Option E example includes a plurality of circles, in varying sizes, and a series of angled straight lines. The circles are aligned in rows with a straight line preferably aligned and intersecting the circles. As shown, each straight line is transverse to and intersects with two side edges of each circle. In FIG. 5 it is shown that this Option E pattern includes a relatively high level of score lines at 6.43 linear inches per cell, or with a score line to cell area ratio of about 13.7. FIG. 6 shows a high level of intersections per cell at 19, assuming the alignment/registration of the angles lines and circle pattern is maintained.

Option F provides a series of concentric circles with angled, parallel straight lines. FIG. 5 shows the total length of lines per cell as 6.18 linear inches, with a score line to cell area ratio of about 13.1. FIG. 6 identified the number of intersections as 12 per cell. In this embodiment, the positioning of the lines may have an affect on the number of intersections.

Option G includes a series of parallel straight lines combined with a series of zig-zag lines. The zig-zag lines create a diamond shape that is traversed by intersecting straight lines. This Option G is an example of a score line pattern that may provide relatively consistent results for push-through force despite a shifting of the two line pattern positions or a shifting of the overall pattern relative to the cell position. FIG. 5 identifies a total linear length score lines per cell as 7.45 inches. The score line to cell area ratio is about 15.9. The number of intersections per cell, as shown in FIG. 6, is designated as 16. Again, the spacing and resulting density of the zig-zag lines (or the straight lines) will affect the overall linear length of the score lines and the number of intersection within a defined cell area.

In Option H, there is shown an overlap pattern of offset circles. The position of the circle rows creates an edge overlap in 4 places, with 8 intersections. In FIG. 5, the graph shows relatively low total line length of 3.76 linear inches per cell, which is a score line to cell area ratio of about 8.0. In FIG. 6, the graph shows the intersection total per cell to be 10. Changes in the diameter of the circles will affect this intersection number and may also affect the total line length per cell in the pattern.

A useful blister package may be formed with a polymer top layer secured to the blister tray sealing flange having a score pattern formed in at least one surface and overlapping the cell. The score pattern is provided for promoting propagation of a tear in the top layer upon application of a transverse force of the product within the blister cell against the portion of the top layer overlapping the cell. In the above examples, a monolayer of polyester (0.0012 inches thick) was utilized. The score lines were targeted to cut into the film at 70% of the film thickness. This target cut depth was normally accepted in a range of plus or minus 10%. This structure and the identified score line patterns were then compared to the target foil push-through force. The various score patterns discussed herein may have multiple applications, including such examples as pharmaceuticals, soap tablets, etc. A relatively large push through force may be desirable in some applications. Variations in the top layer material, the thickness of the top layer, and the depth of cut may be incorporated into the various applications.

In comparing the various score line embodiments shown, the patterns identified as Options A, Option D, Option F and Option G were found to provide consistent results as compared to the target range for push-through. Based the empirical data and observation, these score pattern will create positive push-through force results. These score line patterns include a total of at least 5 inches of linear score lines per cell or a score line to cell area ratio of at least 10.6. Moreover, the results were found to further improve when the score line linear length exceeded 6 inches or a score line to cell area ratio exceed 12.8. Further, these preferred score line lengths and ratio numbers are coupled with a number of line intersections in the pattern. The preferred number of score line intersections is at least 10, and preferably exceeding 12.

As for Options B, C and E, the results were affected by registration of the two score line patterns during formation of the overall pattern on the polymer web and further by the form of the score lines. For example, the relatively sharp apex of the chevrons of Option B has a tendency to form an inconsistent cut in the polymer web. A variation of this pattern, with a rounded apex is contemplated to resolve this separate issue, while meeting the preferred linear length and intersection parameters defined. Options C and E were found to be affected by registration issues between the X and crossing line patterns with the circles. Positional variations affected the depth of cut in addition to varying the number of intersections and overall linear length of score lines within the cells tested. Elimination of the registration complications is contemplated to remove inconsistencies within the push-through measurement. With respect to Option H, the low number of intersections resulted in relatively inconsistent push-through results. (Registration issues also affected the testing results, independent of the intersection limitation issue.)

The line pattern options shown and described illustrate that variations in the form of the line patterns and the density of the lines each affect the total linear length of the score lines in the cells and a total number of intersections. These two parameters are not necessarily proportional; hence, the same result may not occur if there is an increase in one number with a corresponding reduction in the other. Further, line patterns different from those shows may produce desirable results. As noted above, selection of a pattern that is relatively simple may affect the overall acceptability of the pattern, due to the preferred method of applying different portions of the overall score line pattern at different stations in the formation process. As noted, registration of the score line portions during the die-cutting operation (as an example) may affect performance results. A further factor in the selection of a score line pattern is the depth of cut. A consistent depth is desirable, although variations may be acceptable, depending on user requirements and the line pattern selected.

In the drawings and specification, there has been set forth a number of embodiments of the invention and, although specific terms are employed, these terms are used in a generic and descriptive sense only and not for purposes of limitation. The scope of the invention is set forth one or more of the claims.

What is claimed is:

1. A blister package for retaining individual products, the package comprising:

a receptacle substrate, the receptacle substrate having a sealing flange and at least one receiving cell formed to retain product therein, the sealing flange surrounding the at least one receiving cell, and a cell area surrounded by and defined inwardly of the sealing flange, and a top layer covering the cell area of the at least one receiving cell and a portion thereof overlapping and sealed to the sealing flange, the top layer consisting essentially of a polymer material, and a score pattern formed in at least one surface of the top layer and overlapping the cell area of the at least one receiving cell, the score pattern formed for promoting propagation of a tear in the top layer upon application of a transverse push force of the product within the at least one receiving cell against the portion of the top layer overlapping the cell area of the at least one receiving cell, the score pattern defined by a first plurality of rows of score lines formed in a repeating pattern, the pattern of the first plurality of score lines including a series of elongated line segments each extending substantially continuously across the top layer overlapping the cell area of the at least one receiving cell and extending substantially continuously between spaced positions on the sealing flange that surrounds the cell area, and a second plurality of rows of spaced score lines formed in a repeating pattern across the top layer overlapping the cell area of the at least one receiving cell, the first and second plurality of rows overlapping one another to define a plurality of score intersections, and the score pattern having a total linear scored length of score lines per cell of at least 5 inches, and the total number of score intersections created by the score lines within the top layer covering the at least one receiving cell is at least 10.

2. A blister package as in claim 1, wherein the portion of the top layer covering the cell area of the at least one receiving cell is less than 0.5 square inches.

3. A blister package as in claim 1, wherein the second plurality of score lines includes a repeating pattern of circles.

4. A blister package as in claim 3, wherein the circles vary in diameter within the pattern.

5. A blister package as in claim 1, wherein the first plurality of score lines includes a repeating pattern of angled straight lines.

6. A blister package as in claim 1, wherein the first plurality of score lines includes a repeating pattern of crossed straight lines.

7. A blister package as in claim 3, wherein the repeating pattern of circles includes a plurality of concentric circles.

8. A blister package as in claim 1, wherein one of the plurality of score lines includes a repeating pattern of angled straight lines.

9. A blister package as in claim 1, wherein the first plurality of score lines includes a repeating pattern of chevrons.

10. A blister package as in claim 9, wherein the second plurality of score lines includes a pattern of chevrons positioned in an opposing direction from the first plurality.

11. A blister package as in claim 1, wherein the second plurality of score lines includes a repeating pattern of zig-zag lines.

12. A blister package as in claim 1, wherein the second plurality of score lines includes a repeating pattern of curved lines formed in multiple rows across the at least one receiving cell.

13. A blister package as in claim 1, wherein one of the pluralities of score lines includes a repeating pattern of parallel straight lines formed parallel to the machine direction during the formation of the top layer.

14. A blister package as in claim 1 wherein the top layer comprises a laminate composed of multiple layers of polymer material.

15. A blister package as in claim 1 wherein the top layer further comprises a seal coating, and wherein the top layer is heat sealed to the sealing flange of the receptacle substrate, the seal coating facilitating heat sealing of the top layer to the sealing flange.

16. A blister package for retaining individual products, the package comprising:

a receptacle substrate, the receptacle substrate having at least one receiving cell formed to retain product therein and a sealing flange surrounding the at least one receiving cell, and a polymer top layer covering the at least one receiving cell and a portion thereof overlapping and sealed to the sealing flange, and a score pattern formed in at least one surface of the top layer and overlapping the at least one receiving cell, the score pattern formed for promoting propagation of a tear in the top layer upon application of a transverse push force of the product within the at least one receiving cell against the portion of the top layer overlapping the at least one receiving cell, the score pattern defined by a first plurality of score lines formed in a repeating pattern, the pattern of the first plurality of score lines including lines extending substantially continuously across the portion of the top layer overlapping the at least one receiving cell, from between at least two opposing, spaced positions adjacent the sealing flange, and a second plurality of score lines formed in an repeating pattern across the portion of the top layer overlapping the at least one receiving cell, the first and second pluralities of score lines overlapping one another to define a plurality of score intersections within the portion of the top layer overlapping the at least one receiving cell, wherein each of the score lines in the first plurality create within the continuous portion of the lines a plurality of score intersections with the score lines within the second plurality, wherein the score pattern comprises a total number of score intersections of at least 10, the score pattern comprises a total linear scored length of score lines overlapping the at least one cell of at least 5 inches, and the portion of the top layer inwardly of the sealing flange and overlapping the at least one receiving cell having an area of less than 0.5 square inches.

17. A blister package as in claim 16 wherein the score pattern comprises a total number of score intersections of at least 12.

18. A blister package as in claim 16 wherein the score pattern comprises a total linear length over the at least one receiving cell of at least 6 inches.

19. A blister package for retaining individual products, the package comprising:

a receptacle substrate, the receptacle substrate having a sealing flange and a plurality of receiving cells, each receiving cell formed to retain product therein, and a portion of the sealing flange surrounding each receiving cell, and a polymer top layer covering the receptacle substrate, overlapping each receiving cell and a portion thereof sealed to the sealing flange for enclosing each receiving cell, and a score pattern formed in at least one surface of the top layer and overlapping each of the plurality of receiving cells, the score pattern formed for promoting propagation of a tear in the top layer upon application of a transverse push force of the product within a receiving cell against the portion of the top layer overlapping the receiving cell, the score pattern defined by a first plurality of elongated score lines formed in a repeating pattern, the pattern of the first plurality of score lines including multiple lines extending substantially continuously across a portion of the top layer overlapping each of the receiving cells and each of the multiple lines extending continuously between two opposing, spaced positions adjacent the sealing flange surrounding each of the receiving cells, and a second plurality of elongated score lines formed in an offset repeating pattern across the portion of the top layer overlapping each of the receiving cells, the first and second pluralities of score lines defining an overall scoring length and overlapping one another to define a plurality of score intersections for each receiving cell, wherein the score pattern comprises a total number of score intersections of at least 10 positioned over each receiving cell, and wherein the ratio of linear score line length to the area of the portion of the top layer overlapping each receiving cell is in excess of 10.6.

20. A blister package as in claim 19 wherein the score pattern comprises a total linear length per cell of at least 5 inches.

21. A blister package as in claim 19 wherein the ratio of linear score line length to the area of the top layer overlapping each receiving cell is in excess of 12.8.

22. A blister package as in claim 19 wherein the area of the top layer overlapping each of the receiving cells is less than 0.5 square inches.

* * * * *